US005348410A

United States Patent [19]

Shozi et al.

[11] Patent Number: 5,348,410

[45] Date of Patent: Sep. 20, 1994

[54] CYLINDRICAL COSMETIC CONTAINER WITH FLEXIBLE BRAKE

[75] Inventors: Yukio Shozi; Satoru Naramoto, both of Kashiwa, Japan

[73] Assignee: Hidan Co., Chiba, Japan

[21] Appl. No.: 63,150

[22] Filed: May 18, 1993

[30] Foreign Application Priority Data

Oct. 30, 1992 [JP] Japan ..... 4-081052[U]

[51] Int. Cl.[5] ..... A45D 40/06; A45D 40/12

[52] U.S. Cl. ..... 401/78; 401/80

[58] Field of Search ..... 401/78, 80

[56] References Cited

U.S. PATENT DOCUMENTS

| | | | |
|---|---|---|---|
| 4,812,066 | 3/1989 | Gueret | 401/78 |
| 5,186,560 | 2/1993 | Holloway | 401/78 |
| 5,186,561 | 2/1993 | Ackerman et al. | 401/78 |
| 5,234,275 | 8/1993 | Gueret | 401/78 |

FOREIGN PATENT DOCUMENTS 63-166111 10/1988 Japan .

*Primary Examiner*—Steven A. Bratlie

*Attorney, Agent, or Firm*—Frishauf, Holtz, Goodman & Woodward

[57] ABSTRACT

A cylindrical cosmetic container includes an inner tubular member (1) formed with axially extending slots (2); an outer tubular member (7) formed with a spiral groove (9) and rotatably fitted to an outer circumferential surface of the inner tubular member; and a movable cup member (11) for mounting thereon a cylindrical cosmetic (15) to be accommodated within the inner tubular member, and the movable cup member having projection pins (13) attached on an outer circumferential surface thereof and engaged with the spiral groove of the outer tubular member through the slots of the inner tubular member. The inner tubular member (1) is formed with a bridge portion (101) at a base end portion thereof; and the bridge portion is further formed with a projection portion (103) which is brought into elastic contact with the base end portion of the outer tubular member. Since the sliding frictional resistance between the inner and outer tubular members can be increased, both the tubular members are not rotated easily relative to each other, even when a force is applied to the movable cup member through the cylindrical cosmetic in the direction in which the cup member is pushed into the container, thus preventing the retractive phenomenon from occurring. Further, since the clearances between the movable cup member and the inner and outer tubular members can be increased, it is possible to eliminate the use of any lubricant.

5 Claims, 6 Drawing Sheets

CYLINDRICAL COSMETIC CONTAINER WITH FLEXIBLE BRAKE

BACKGROUND OF THE INVENTION

1. Field of the Invention

The present invention relates to a cylindrical cosmetic container, and more specifically to a cylindrical cosmetic container which can smoothly move a cylindrical cosmetic (e.g., a lipstick) to be accommodated therein outwardly, while preventing the phenomenon in which the cylindrical cosmetic retracts into the container by a small force in use, without reducing clearances between the respective members and without use of any lubricant.

2. Description of the Prior Art

FIGS. 1A and 1B show an example of the conventional cylindrical cosmetic (lipstick) container, which is composed of an inner tubular member 1, an outer tubular member 7 and a movable cup member 11. These members are all formed of an appropriate resin material, respectively. The inner tubular member 1 is formed with two opposing axially extending slots 3 arranged at 180 degree angular intervals, and is joined with a large diameter base member 5. The outer tubular member 7 is formed with an inner spiral groove 9, and is rotatably fitted to the outer circumferential surface of the inner tubular member 1. The movable cup member 11 is formed with two opposing radially extending projection pins 13 arranged at 180 degree angular intervals, and is slidably fitted to the inner circumferential surface of the inner tubular member 1. A pair of the projection pins 13 project radially outward through the slots 3 of the inner tubular member 1, and are engaged with the spiral groove 9 of the outer tubular member 7, respectively. A transverse wide portion 3*a* is provided at each of the upper and lower portions of extending slot 3 of inner tubular member 1. Further, in a practical cylindrical cosmetic container, after the above-mentioned inner tubular member 1, the outer tubular member 7 and the movable cup member 11 have been all assembled, a lid (not shown) is attached to the assembly. A cylindrical cosmetic such as a lipstick 15 is mounted on the movable cup member 11 so as to be extendable from and retractable into the container.

In use, the lid is first removed. The outer circumferential surface of time outer tubular member 7 is gripped by one hand, and the large diameter base member 5 is gripped by the other hand, to rotate the two gripped members 7 and 5 in two opposite directions, respectively. Then, the movable cup member 11 is rotated according to time relative movement between the inner and outer tubular members 1 and 7, and thereby moved along time spiral groove 9 to let the cylindrical cosmetic 15 out from the container for use. Further, after use, when time large diameter base member 5 is rotated in the reverse direction relative to the outer tubular member 7, the movable cup member 11 is moved along the same spiral groove 9 to let the cylindrical cosmetic 15 retract into the container. Thereafter, the lid is attached.

In the above-mentioned conventional cylindrical cosmetic container, however, there exists a problem in that in use after the movable cup member 11 has been moved so as to protrude from the cylindrical cosmetic 15, the movable cup member 11 or the cylindrical cosmetic 15 is liable to be returned or retract into the container by a small force (Hereinafter, this unfavorable phenomenon is referred to as "retractive phenomenon"), which results in the container not being suitable for use. The reason why the above-mentioned retractive phenomenon occurs is that relatively large clearances are required among the inner tubular member 1, the outer tubular member 7 and the movable cup member 11, in order to allow the movable cup member 11 to be moved smoothly. In other words, when these clearances are too small, the movement resistances between these members increase, so that the movable cup member 11 does not move smoothly.

In summary, there exists a technical background that the smooth movement of the movable cup member 11 and the prevention of the retractive phenomenon are not compatible. As a result, in the conventional container, the refractive phenomenon is prevented by determining the clearances among the inner tubular member 1, the outer tubular member 7 and the movable cup member 11 as small as possible, and further a lubricant such as grease is applied to the respective sliding surfaces to move the movable cup member 11 smoothly. In the conventional container, however, it has been still difficult to securely prevent the above-mentioned retractive phenomenon, and additionally there arises another problem that the lubricant flows out and then sticks onto the cylindrical cosmetic 15 and the outer circumferential surface of the container.

SUMMARY OF THE INVENTION

With these problems in mind, therefore, it is the object of the present invention to provide a cylindrical cosmetic container which can move the movable cud member smoothly for better use and can prevent time retractive phenomenon securely, without use of any lubricant.

To achieve the above-mentioned object, a cylindrical cosmetic container includes an inner tubular member formed with axially extending slots; an outer tubular member formed with a spiral groove and fitted to an outer circumferential surface of the inner tubular member: and a movable cup member for mounting a cylindrical cosmetic to be accommodated within the inner tubular member, the movable cup member having projection pins attached on an outer circumferential surface thereof and engaged with the spiral groove of the outer tubular member through the slots of the inner tubular member, in which the movable cup member is moved up and down by rotating the inner and outer tubular members relative to each other. The inner tubular member further includes a bridge portion formed at a base end portion thereof; and said bridge portion is further formed with a projection portion which is in elastic contact with the base end portion of the outer tubular member.

The bridge portion can be formed into a symmetrical beam supported at both ends thereof and the projection can be formed at a middle of the bridge portion. Further, the bridge portion can be formed into an asymmetrical beam supported at both ends thereof. Further, two bent portions can be formed on both sides of the projection portion formed in the bridge portion. The bridge portion is of single beam type or of double beam type.

In the present invention, the bridge portion is formed at the base portion of the inner tubular member, and the bridge portion is further formed with the projection portion which is in elastic contact with the base end portion of the outer tubular member. In the construction as described above, since the sliding frictional resistance between the inner and outer tubular members can be increased, both the tubular members are not rotated easily relative to each other, even when a force is applied to the movable cup member through the lipstick mounted thereto in the direction that the cup member is pushed into the container, thus preventing the retractive phenomenon from occurring. Further, since the clearances between the movable cup member and the inner and outer tubular members can be increased, it is possible to eliminate the use of any lubricant.

DETAILED DESCRIPTION OF THE PREFERRED EMBODIMENTS

Preferred embodiments of the present invention will be described hereinbelow with reference to the attached drawings.

Figure 1A:
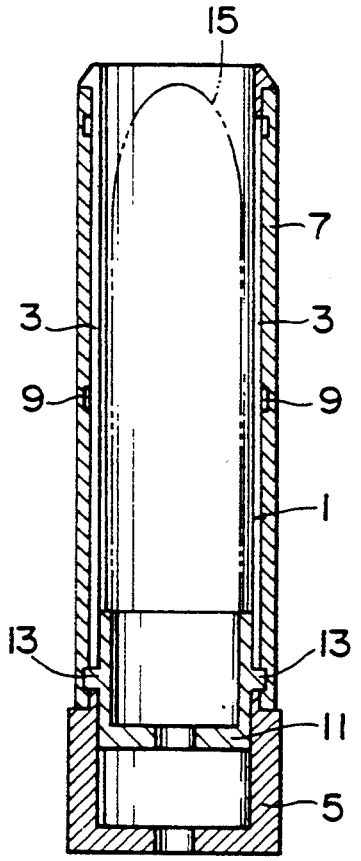
FIG. 1A PRIOR ART
FIG. 1A is a cross-sectional view showing the conventional cylindrical cosmetic container.
Figure 1B:
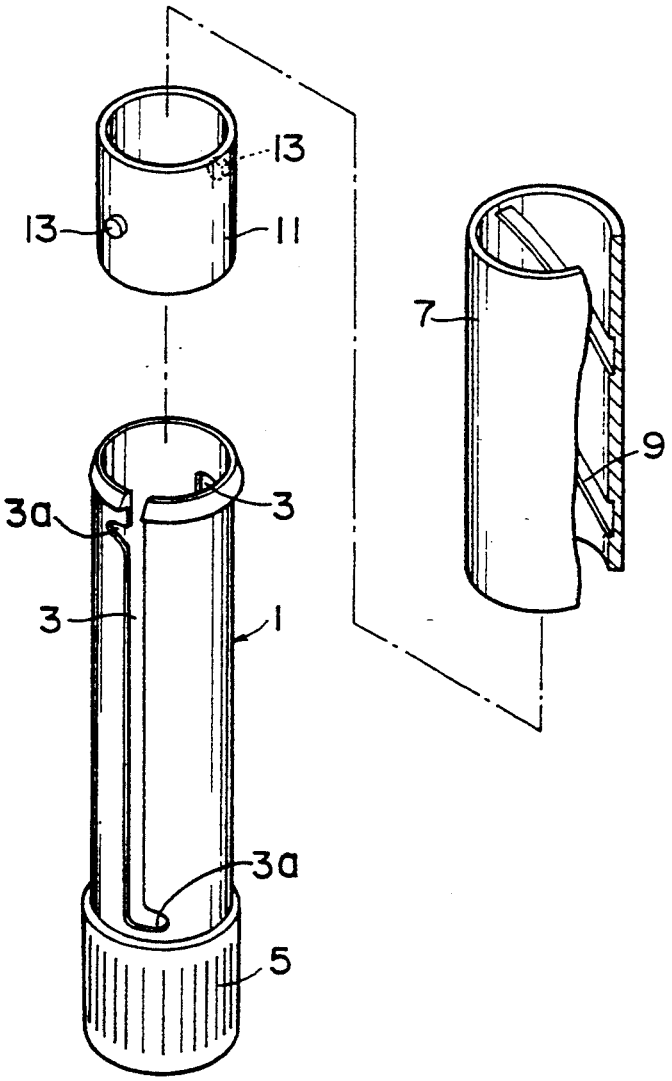
FIG. 1B PRIOR ART
FIG. 1B is an exploded view showing the same conventional cylindrical cosmetic container.
Figure 2A:
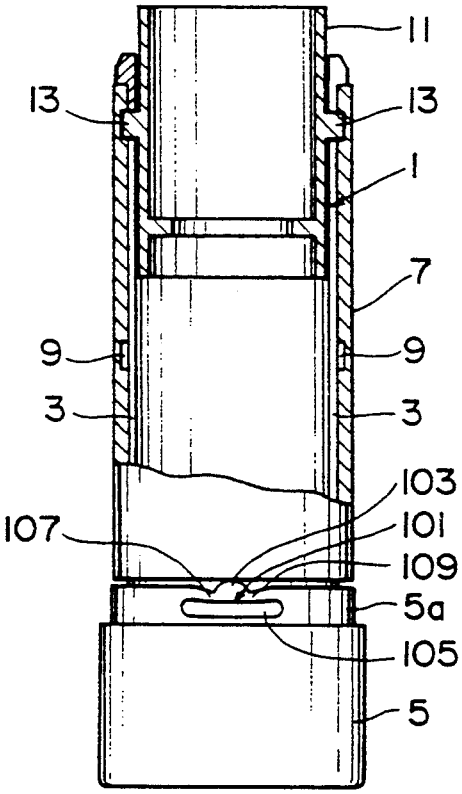
FIG. 2A is an elevational, partially cross-sectional view showing a first embodiment of the cylindrical cosmetic container according to the present invention.
Figure 2C:
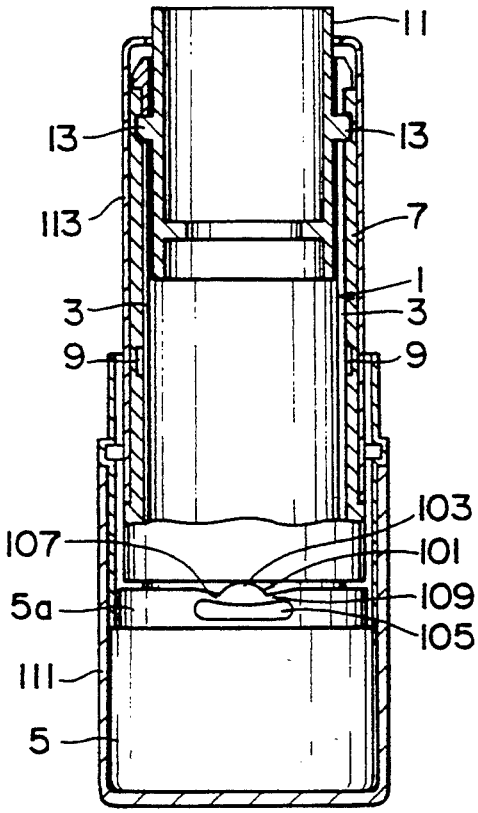
FIG. 2C is a cross-sectional view showing the modification of the first embodiment.
Figure 2B:
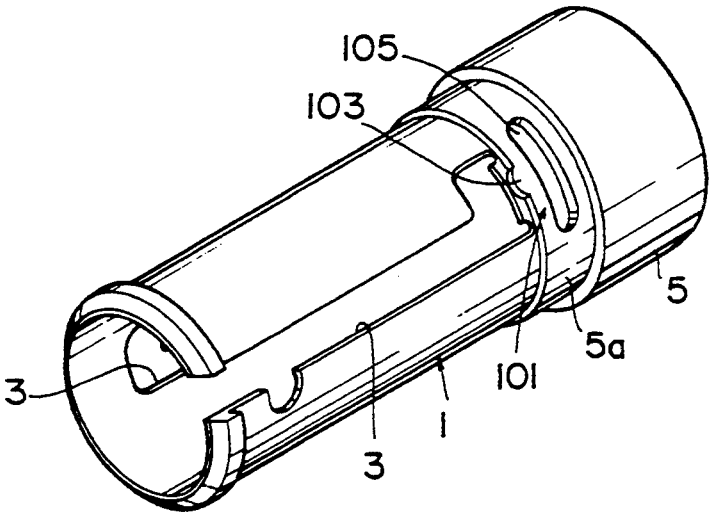
FIG. 2B is a perspective view showing the first embodiment.

FIGS. 2A to 2C show the first embodiment of the present invention, in which the same reference numerals have been retained for the similar parts or elements which have the same functions as those of the conventional cylindrical cosmetic container shown in FIGS. 1A and 1B. The feature of this embodiment is to provide a bridge portion 101 on the end portion of the large diameter base member 5 of the inner tubular member 1 and further to form a projection portion 103 at the middle portion of the formed bridge portion 101. The projection portion 103 is so provided as to be brought into elastic contact with the base end of the outer tubular member 7. The bridge portion 101 is described in further detail. The large diameter base member 5 is formed with a reduced diameter portion **5*a* on the upper side thereof. The reduced diameter portion 5*a* is formed with a cutout portion 105 so as to form the bridge portion 101 on the upper side of this cutout portion 105. The bridge portion 101 is formed into a beam supported at both ends. Both sides of the projection portion 103 are formed into a tapered shape or rounded slightly, as shown by numerals 107 and 109. Further, the large diameter base member 5 can be formed independently from the inner tubular member 1 so as to be jointly associated with the inner tubular member 1. Further, in this embodiment, it is possible as shown in FIG. 2C, to provide an intermediate lid 113 which is attached to the outer circumferential surface of the outer tubular member 7**.

In the first embodiment, the projection portion 103 is brought into elastic contact with the base end of the outer tubular member 7 so as to provide an appropriate sliding frictional resistance between the inner tubular member 1 and the outer tubular member 7, while keeping the clearances among the inner tubular member 1, the outer tubular member 7 and the movable cup member 11 at relatively large values, without using any lubricant as used in the conventional containers. In the case of the conventional containers, the retractive phenomenon has been prevented by reducing the clearances among the members 1, 7 and 11, and further the resultant sliding frictional resistances among these members have been reduced by using a lubricant, as stated in the above. In contrast with this, in the present embodiment, the retractive phenomenon is prevented by elastically abutting the projection portion 103 of the bridge portion 101 onto the base end of the outer tubular member 7, so that it is possible to determine the clearances among these members 1, 7 and 11 to appropriate large values, thus eliminating the use of any lubricant. Further, as shown in FIG. 2C, it is possible to further include a casing 111 which is attached to the large diameter base member 5.

In the above-mentioned embodiment, since the projection portion 103 is in elastic contact with the base end of the outer tubular member 7, it is possible to obtain an appropriate resistance between the inner and outer tubular members 1 and 7, which can prevent the retractive phenomenon from occurring. Further, since the clearances among the inner tubular member 1, the outer tubular member 7 and the movable cup member 11 are so determined to have appropriate large values, respectively, it is possible to eliminate the use of lubricant and solve various problems caused by use of lubricant. Further, since the projection portion 103 is formed at the middle portion of the bridge portion 101 in the form of a symmetrical beam supported at the opposite ends thereof, it is possible to obtain a sufficient strength and thereby to provide a stable elastic function for many hours. In addition, even if there exists dimensional dispersion with respect to the respective members, an appropriate elastic force can absorb it effectively, thus resulting in such an advantage that the dimensional management of the respective members can be facilitated.

Figure 3A:
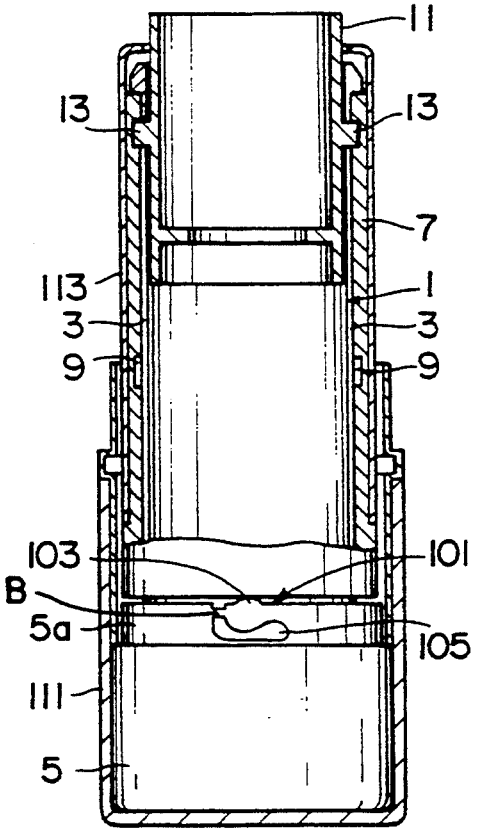
FIG. 3A is a cross-sectional view showing a second embodiment of the cylindrical cosmetic container according to the present invention.
Figure 3B:
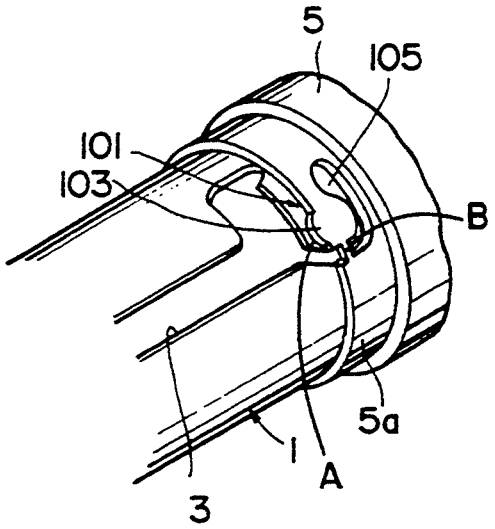
FIG. 3B is a partial perspective view showing the second embodiment.

FIGS. 3A and 3B show the second embodiment of the present invention. The feature of this second embodiment is to form the bridge portion 101, the projection portion 103 and the cutout portion 105 In asymmetrical fashion in the direction perpendicular to the axial direction thereof. In the case where these portions are formed in asymmetrical relationship with respect to the axial direction of the container, it is possible to obtain the same effect as with the case of the first embodiment of symmetrical shape. With this embodiment, a thin and short plate-like bridge B, shown in FIGS. 3A and 3B, is provided at the tip portion of the beam. Further, a plate A is provided behind the projection portion 103, as shown in FIG. 3B.

Figure 4A:
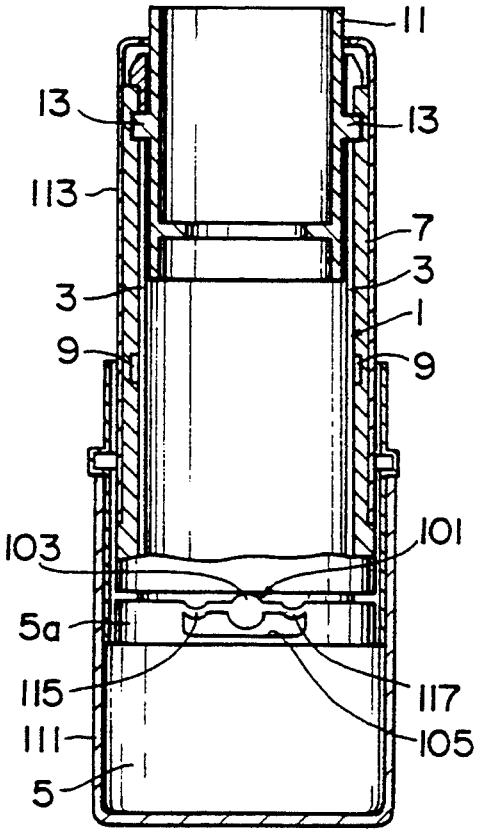
FIG. 4A is a cross-sectional view showing a third embodiment of the cylindrical cosmetic container according to the present invention.
Figure 4B:
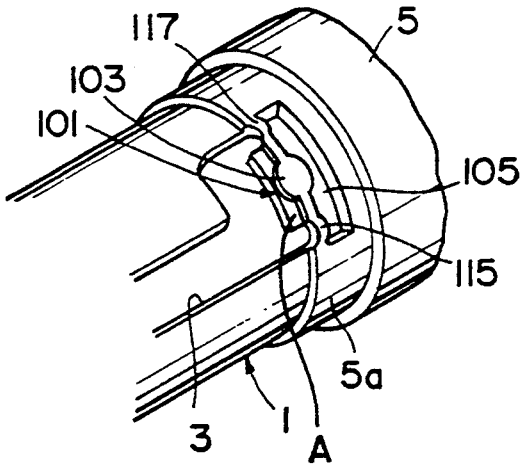
FIG. 4B is a partial perspective view showing the third embodiment.

FIGS. 4A and 4B show the third embodiment of the present invention. The feature of this third embodiment is to form the bridge portion 101, the projection portion 103 and the cutout portion 105 all in symmetrical shape, and further to form two bent portions 115 and 117 at the bridge portion 101 on both side positions of the projection portion 103. In the construction as described above, it is possible to obtain the same effect as with the case of the first and second embodiments. In this embodiment, since the elastic range can be further increased by additionally forming the two bent portions 115 and 117, It is possible to increase the allowable range of the dimensional dispersion among the respective members. A plate A is provided behind the projection portion 103, as shown in FIG. 4B.

Figure 5A:
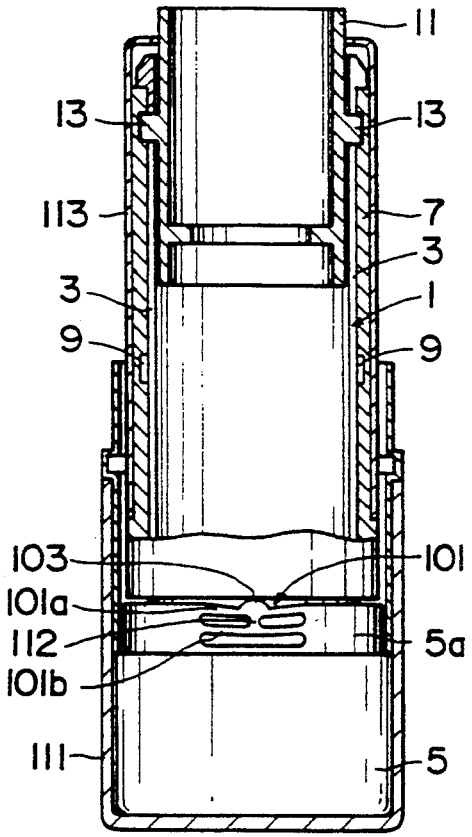
FIG. 5A is a cross-sectional view showing a fourth embodiment of the cylindrical cosmetic container according to the present invention.
Figure 5B:
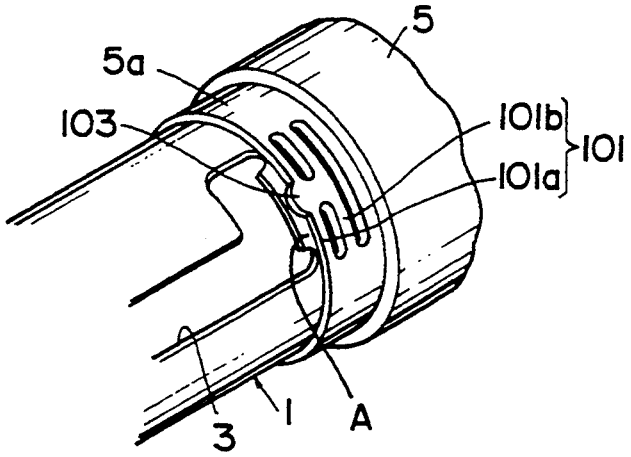
FIG. 5B is a partial perspective view showing the fourth embodiment.

FIGS. 5A and 5B show the fourth embodiment of the present invention. The feature of this fourth embodiment is to form the bridge portion 101 in double bridge fashion. In more detail, the bridge portion 101 is Formed into a double beam type, that is the bridge portion 101 is composed of upper and lower bridge portions 101*a* and 101*b* arranged to be substantially parallel in the vertical direction and linked with each other via a link portion 112, and the projection portion 103 is integrally formed on the upper bridge portion 101*a*. In this structure, it is possible to obtain the same effects as those of the first to third embodiments. A plate A is provided behind the projection portion 103, as shown in FIG. 5B.

Figure 6:
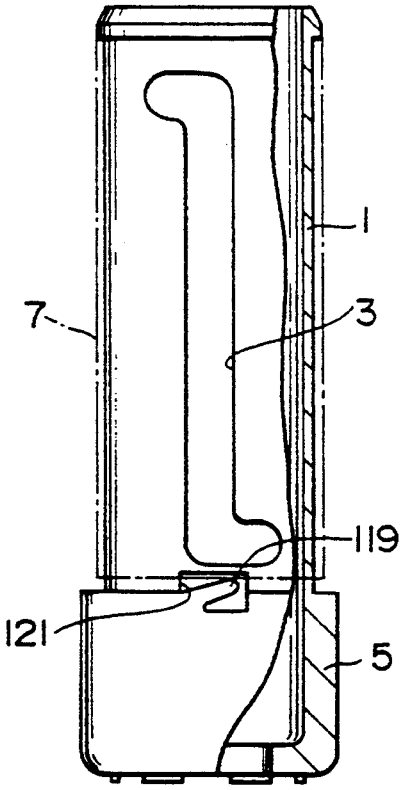
FIG. 6 is an elevational, partly broken view showing the inner tubular member of a fifth embodiment of the cylindrical cosmetic container according to the present invention.

FIG. 6 shows the fifth embodiment of the present invention. The feature of tills fifth embodiment is to form a tongue-like protruding portion 119 at the base end portion of the inner tubular member 1 so that the protruding portion 119 is brought into elastic contact with the base end of the outer tubular member 7. In this case, it should be noted that the tongue-like protruding portion 119 functions as the bridge portions 101 of the above embodiments. In FIG. 6, the reference numeral 121 denotes a cutout. The contact between the inner tubular member 1 and the outer tubular member 7 via the protruding portion 119 can increase the sliding frictional resistance between the two members, thus preventing the retractive phenomenon from effectively occurring.

Figure 7:
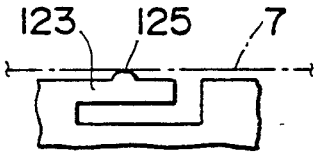
FIG. 7 is a partial view showing a part of the inner tubular member of a sixth embodiment of the cylindrical cosmetic container according to the present invention.

FIG. 7 shows the sixth embodiment of the present invention. The feature of this sixth embodiment is to form a cantilever-shaped portion 123 having an integrally formed additional projection 125 which is brought into elastic contact with the base end of the outer tubular member 7. In this case, It should be noted that the cantilever-shaped protruding portion functions as the bridge portions 101 of the above embodiments. In this embodiment, it is possible to prevent a decrease in strength of the cantilever-shaped protruding portion that would occur with passage of time.

Further, it should be also noted that the present invention is not limited to only the above-mentioned embodiments. For instance, the structure of the projection portion and the bridge portion are not limited to only those as shown in the drawings. The bridge portion 101 can be formed by three or more bridges which are arranged along the periphery, and the projection portion 103 can be formed from two or more projections.

Further, the position, number, size and shape of the protruding portion are not limited to only those as shown. Although not shown, it is possible to form a protruding portion or convex portion in the inner circumferential surface of the outer tubular member 7 as means for increasing the sliding frictional resistance between the inner tubular member 1 and the outer tubular member 7.

As described above, in the cylindrical cosmetic container according to the present invention, since the bridge portion is provided at the base portion of the inner tubular member; and further the projection is formed in the bridge portion so as to be in elastic contact with the base end of the outer tubular member, it is possible to smoothly move the movable cup member (lipstick, for instance) out, without reducing the clearances among the inner tubular member, the outer tubular member and the movable cup member and further without use of any lubricant, while preventing the retractive phenomenon from occurring. Since no lubricant is used, the problems derived from the use of lubricant as described in connection with the conventional container can be solved perfectly.

What is claimed is:

1. A cylindrical cosmetic container including:

an inner tubular member formed with axially extending slots and having an outer circumferential surface and a base end portion;

an outer tubular member formed with a spiral groove and rotatably fitted to the outer circumferential surface of said inner tubular member, said outer tubular member having a lower edge; and a movable cup member for mounting thereon a cylindrical cosmetic to be accommodated within said inner tubular member, the movable cup member having projection pins attached on an outer circumferential surface thereof and engaged with the spiral groove of the outer tubular member through the slots of said inner tubular member, said movable cup member being moved by rotating said inner and outer tubular members relative to each other; and wherein said inner tubular member is formed with a bridge portion at the base end portion of said inner tubular member; and said bridge portion is further formed with a projection portion which is brought into elastic contact with the lower edge of said outer tubular member, said bridge portion being further formed with two bent portions on both sides of said projection portion.

2. A cylindrical cosmetic container including:

an inner tubular member formed with axially extending slots and having an outer circumferential surface and a base end portion;

an outer tubular member formed with a spiral groove and rotatably fitted to the outer circumferential surface of said inner tubular member, said outer tubular member having a lower edge; and a movable cup member for mounting thereon a cylindrical cosmetic to be accommodated within said inner tubular member, the movable cup member having projection pins attached on an outer circumferential surface thereof and engaged with the spiral groove of the outer tubular member through the slots of said inner tubular member, said movable cup member being moved by rotating said inner and outer tubular members relative to each other; and wherein said inner tubular member is formed with a bridge portion at the base end portion of said inner tubular member, and said bridge portion is further formed with a projection portion which is brought into elastic contact with the lower edge of said outer tubular member, said bridge portion being formed into an asymmetric beam supported at both ends thereof.

3. A cylindrical cosmetic container including:

an inner tubular member formed with axially extending slots and having an outer circumferential surface and a base end portion;

an outer tubular member formed with a spiral groove and rotatably fitted to the outer circumferential surface of said inner tubular member, said outer tubular member having a lower edge; and a movable cup member for mounting thereon a cylindrical cosmetic to be accommodated within said inner tubular member, the movable cup member having projection pins attached on an outer circumferential surface thereof and engaged with the spiral groove of the outer tubular member through the slots of said inner tubular member, said movable cup member being moved by rotating said inner and outer tubular members relative to each other; and wherein said inner tubular member is formed with a bridge portion at the base end portion of said inner tubular member, and said bridge portion is further formed with a projection portion which is brought into elastic contact with the lower edge of said outer tubular member, said bridge portion being of a double beam type.

4. A cylindrical cosmetic container including:

an inner tubular member formed with axially extending slots and having an outer circumferential surface and a base end portion;

an outer tubular member formed with a spiral groove and rotatably fitted to the outer circumferential surface of said inner tubular member, said outer tubular member having a lower edge; and a movable cup member for mounting thereon a cylindrical cosmetic to be accommodated within said inner tubular member, the movable cup member having projection pins attached on an outer circumferential surface thereof and engaged with the spiral groove of the outer tubular member through the slots of said inner tubular member, said movable cup member being moved by rotating said inner and outer tubular members relative to each other; and wherein said inner tubular member is formed with a tongue-like protruding portion which is formed from a resilient member at the base end portion of said inner tubular member, and said protruding portion is brought into elastic contact with the lower edge of said outer tubular member.

5. A cylindrical cosmetic container including:

an inner tubular member formed with axially extending slots and having an outer circumferential surface and a base end portion;

an outer tubular member formed with a spiral groove and rotatably fitted to the outer circumferential surface of said inner tubular member, said outer tubular member having a lower edge; and a movable cup member for mounting thereon a cylindrical cosmetic to be accommodated within said inner tubular member, the movable cup member having projection pins attached on an outer circumferential surface thereof and engaged with the spiral groove of the outer tubular member through the slots of said inner tubular member, said movable cup member being moved by rotating said inner and outer tubular members relative to each other; and wherein said inner tubular member is formed with a cantilever-shaped portion which is formed from a resilient member and on which an additional projection is formed, at the base end portion of said inner tubular member, and said additional projection of said cantilever-shaped portion is brought into elastic contact with the lower edge of said outer tubular member.

* * * * *